US006016074A

United States Patent [19]

Yamamori

[11] Patent Number: 6,016,074

[45] Date of Patent: Jan. 18, 2000

[54] PROGRAMMABLE REFERENCE VOLTAGE CIRCUIT

[75] Inventor: Manabu Yamamori, Tokyo, Japan

[73] Assignee: NEC Corporation, Tokyo, Japan

[21] Appl. No.: 08/941,365

[22] Filed: Sep. 30, 1997

[30] Foreign Application Priority Data

Sep. 30, 1996 [JP] Japan ..... 8-257252

[51] Int. Cl.[7] ..... G05F 3/02

[52] U.S. Cl. ..... 327/541; 327/543; 323/315

[58] Field of Search ..... 327/538, 540, 327/541, 543; 323/313, 315

[56] References Cited

U.S. PATENT DOCUMENTS

| | | | |
|---|---|---|---|
| 4,761,603 | 8/1988 | Nodera | 323/315 |
| 4,855,685 | 8/1989 | Hochschild | 330/282 |
| 4,958,086 | 9/1990 | Wang et al. | 327/380 |
| 5,254,883 | 10/1993 | Horowitz et al. | 326/30 |
| 5,339,020 | 8/1994 | Siligoni et al. | 323/313 |
| 5,467,052 | 11/1995 | Tsukada | 327/543 |
| 5,773,967 | 6/1998 | Tenten | 323/313 |

*Primary Examiner*—Terry D. Cunningham
*Attorney, Agent, or Firm*—Foley & Lardner

[57] ABSTRACT

A programmable reference voltage circuit includes a reference voltage output terminal, a ground terminal, and a power terminal, where the power terminal is connected through a current source to the reference voltage output terminal. The programmable reference voltage circuit further includes first, second and third bipolar transistors. The first bipolar transistor is connected by way of its collector through a first resistance to the reference voltage output terminal, and is connected by way of its emitter to the ground terminal. The second bipolar transistor is connected by way of its collector through a second resistive element to the reference voltage output terminal, and is connected by way of its emitter to the ground terminal. The third bipolar transistor is connected the reference voltage output terminal, the second bipolar transistor, and the ground terminal. A resistive element selecting circuit is connected between the emitter of the second bipolar transistor and the ground terminal, and includes a plurality of selectable resistive elements connected in parallel, with each one having a different resistance value. The selecting circuit is capable of selecting any particular one of the selectable resistive elements, so as to achieve a particular reference voltage.

1 Claim, 3 Drawing Sheets

PROGRAMMABLE REFERENCE VOLTAGE CIRCUIT

BACKGROUND OF THE INVENTION

The present invention relates to a progammable reference voltage circuit, and more particularly to a programmable reference voltage circuit capable of setting an output voltage level in accordance with exeternal data.

A conventional programmable reference voltage circuit will be described with reference to FIG. 1. The conventional programmable reference voltage circuit has three transistors Q1, Q2 and Q3 and a current source 4. The transistor Q1 has a base and a collector which are interconnected to each other and also connected through a resistor R1 to a reference voltage output terminal 1 on which a reference voltage output Vref appears. A current I1 flows through the resistor R1 from the reference voltage output terminal 1 to the base and collector of the transistor Q1. The transistor Q1 has an emitter connected to a ground terminal 2 kept to have a ground potential. The transitor Q2 has a collector which is connected through a resistor R2 to the reference voltage output terminal 1. A current I2 flows through the resistor R2 from the reference voltage output terminal 1 to the collector of the transistor Q2. The transistor Q2 has an emitter connected through a resistor R3 to the ground terminal 2, and a base connected to the base of the transistor Q1. The transistor Q3 has a collector which is connected to the reference voltage output terminal 1 and a base connected to the collector of the transistor Q2 as well as an emitter connected to the ground terminal 2. A power voltage terminal 3 is connected through the current source 4 to the collector of the transistor Q3 and to the reference voltage output terminal 1 as well as to the resistors R1 and R2. An emitter size ratio of the transistor Q1 to the transistor Q2 is 1: N. An emitter size ratio of the transistor Q1 to the transistor Q3 is 1:1.

The output voltage Vref appearing on the reference voltage output terminal 1 is defined by the emitter size ratio of transistors Q1 and Q2 and the three resistors R1, R2 and R3. The output voltage Vref may be expressed by the following equation, Vbe means a base-emitter voltage. $V_{BEQ1}$ means the base-mitter voltage of the transistor Q1.

$$\text{Vref}=I2\times R2+V_{BEQ3} \tag{1}$$

The current I2 will be found.

$$V_{BEQ1}=V_{BEQ2}+R3\times I2$$

The above equation may be rewritten to $$R3\times I2=V_{BEQ1}-V_{BEQ2} \tag{2}$$

$$V_{BEQ1}=(kT/q)\ln(I1/Is) \tag{3}$$

$$V_{BEQ2}=(kT/g)\ln)I2/N-Is) \tag{4}$$

$$I1=(\text{Vref}-V_{BEQ1})/R1 \tag{5}$$

$$I2=(\text{Vref}-V_{BEQ3})/R2 \tag{6}$$

where "k" is the Boltzmann's constant, "T" is the absolute temperature "q" is the charge of electron and "Is" is the saturation current. The equations (3), (4), (5), and (6) are substituted for the equation (2) to obtain the following equation.

$$I2\cdot R3=(kT)/q[\ln\{(\text{Vref}-V_{BEQ1})/(Is\cdot R1)\ln\ \{(\text{Vref}-V_{BEQ3})/(N\cdot Is\cdot R1)\}]$$

Since the transistors Q1 and Q3 have the same emitter size, it is possible to approximate as follows.

$$V_{BEQ1}=V_{BEQ3} \tag{7}$$

The equation (8) is substituted for the equation (1) to obtain the following equation.

$$\text{Vref}=V_{BEQ3}+(R2/R3)\cdot(kT/q)\ln(N\cdot R2\cdot R1)$$

Since a temperature coefficient of the base-emitter voltage $V_{BEQ3}$ of the transistor Q3 is −2 mV/° C., the equation is set so that the temperature coefficient in the second term of the right side is 2 mV/° C., whereby zero gradient of the temperature coefficient of the output voltage is obtained. This means that variation of the reference voltage due to temperature variation is eliminated.

The above conventional circuit has a disadvantage in that the reference output voltage "Vref" is fixed or constant. In analog circuits, the reference voltage circuit is applicable to various circuits, for example, a comparator circuit utilizing the reference voltage level as a threshold voltage level a differential amplifier and a constant current circuit suitable for setting the contact current securely. The reference voltage circuit is suitable for setting the bias voltage to be applied to the analog circuit. The bias current is the most basic factor of the analog circuit for setting the consumption current, the bias voltage level, amplification degree, amplitude, and defining a frequency characteristic of the transistor which depends upon the bias current.

It is, however, required or preferable to vary the reference voltage. For example, the threshold voltage level is adjusted to the optimum level. The bias current is varied to obtain the optimum amplification degree or optimum amplitude. Further, it is required to set the optimum frequency characteristic of the transistor.

Since the above conventional reference voltage circuit is capable of generating the predetermined constant reference voltage, many different reference voltage circuits are needed to satisfy the above requirement. The many different reference voltage circuits are included in the integrated circuit and switched by switching elements. This results in an enlargement in size of the integrated circuit and also in an increased manufacturing cost thereof.

Due to the above circumstances, it had been required to develop a reference voltage circuit which is capable of varying an output reference voltage level.

SUMMARY OF THE INVENTION

Accordingly, it is an object of the present invention to provide a novel reference voltage circuit which is free from the above problems.

It is a further object of the present invention to provide a novel reference voltage circuit which is capable of varying an output reference voltage level.

The above and other objects, features and advantages of the present invention will be apparent from the following descriptions.

The present invention provides a progammable reference voltage circuit includes a reference voltage output terminal which a reference voltage is outputted, a ground terminal kept to have a ground potential, and a power terminal from which a power is supplied to the programmable reference voltage circuit and being connected through a current source to the reference voltage output terminal. The programmable reference voltage circuit further includes first, second and third bipolar transistors. A first bipolar transistor has a collector connected through a first resistive element having a first resistance to the reference voltage output terminal, a base connected to the collector, and an emitter connected to the ground terminal. A second bipolar transistor has a collector connected through a second resistive element having a second resistance to the reference voltage output terminal, a base connected to the base of the first bipolar transistor, and an emitter connected through a resistive element selecting circuit to the ground terminal. A third bipolar transistor has a collector connected to the reference voltage output terminal, a base connected to the collector of the second bipolar transistor and an emitter connected to the ground terminal. The resistive element selecting circuit includes a plurality of selectable resistive elements having different resistances from each other. The selectable resistive elements are connected between the emitter and the ground terminal parallel to each other. The resistive element selecting circuit is capable of selecting any one of the selectable resistive elements so that the emitter of the second bipolar transistor is connected through the selected one of the selectable resistive elements to the ground terminal whereby the programmable reference voltage circuit is capable of varying the reference voltage in accordance with the different resistances of the selectable resistive elements. Each of the selectable resistive elements has a selecting signal terminal for receiving a selecting signal so that any one of the selectable resistive elements is selected in accordance with the selecting signals.

BRIEF DESCRIPTIONS OF THE DRAWINGS

Preferred embodiments according to the present invention will be described in detail with reference to the accompanying drawings.

DISCLOSURE OF THE INVENTION

Figure 1:
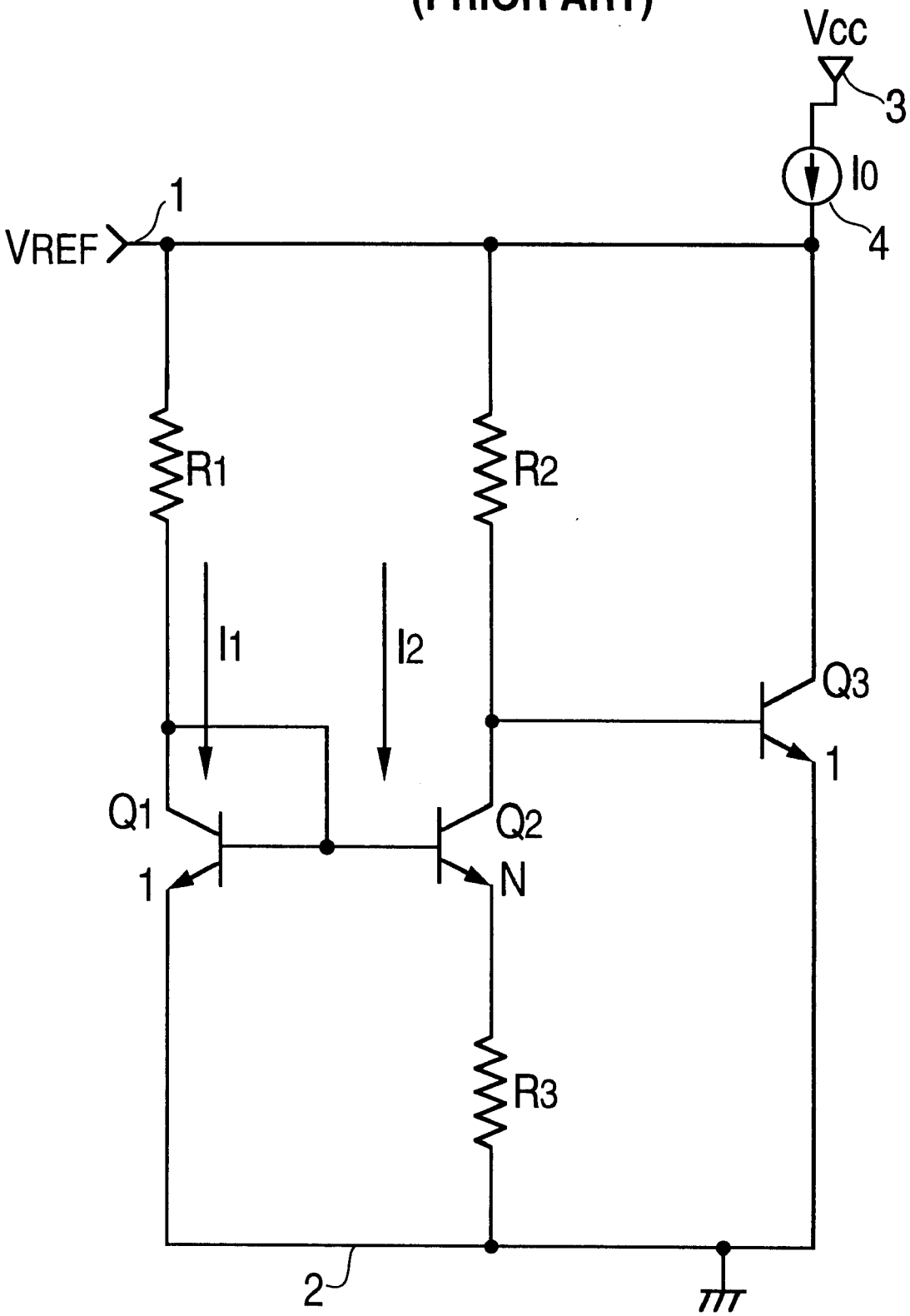
FIG. 1 (PRIOR ART)
FIG. 1 is a circuit diagram illustrative of the conventional reference voltage circuit

The present invention provides a resistive element selecting circuit provided between an emitter of a bipolar transistor and a ground terminal in a programmable reference voltage circuit. The resistive element selecting circuit includes a plurality of selectable resistive elements having different resistances from each other. The selectable resistive elements are connected between the emitter and the ground terminal in parallel to each other. The resistive element selecting circuit is capable of selecting any one of the selectable resistive elements so that the emitter of the second bipolar transistor is connected through the selected one of the selectable resistive elements to the ground terminal whereby the programmable reference voltage circuit is capable of varying the reference voltage in accordance with the different resistances of the selectable resistive elements.

It is preferable that each of the selectable resistive elements has a selecting signal terminal for receiving a selecting signal so that any one of the selectable resistive element is selected in accordance with the selecting signals.

It is further preferable that each of the selectable resistive elements comprises a series connection of a resistor and a switching element between the emitter and the ground terminal and the resistors of the selectable resistive elements have different resistances from each other.

It is further more preferable that the switching element comprises a MOS field effect transistor.

It is alternatively preferable that the selectable resistive elements comprise MOS field effect transistors having different ON-resistances from each other.

The present invention also provides a programmable reference voltage circuit includes a reference voltage output terminal from which a reference voltage is outputted, a ground terminal kept to have a ground potential, and a power terminal from which a power is supplied to the programmable reference voltage circuit, and being connected through a current source to the reference voltage output terminal The programmable reference voltage circuit further includes first second and third bipolar transistors. A first bipolar transistor has a collector connected through a first resistive element having a first resistance to the reference voltage output terminal a base connected to the collector, and an emitter connected to the ground terminal. A second bipolar transistor has a collector connected through a second resistive element having a second resistance to the reference voltage output terminal, a base connected to the base of the first bipolar transistor, and an emitter connected through a resistive element selecting circuit to the ground terminal. A third bipolar transistor has a collector connected to the reference voltage output terminal, a base connected to the collector of the second bipolar transistor and an emitter connected to the ground terminal. The resistive element selecting circuit includes a plurality of selectable resistive elements having different resistances from each other. The selectable resistive elements are connected between the emitter and the ground terminal in parallel to each other. The resistive element selecting circuit is capable of selecting any one of the selectable resistive elements so that the emitter of the second bipolar transistor is connected through the selected one of the selectable resistive elements to the ground terminal, whereby the programmable reference voltage circuit is capable of varying the reference voltage in accordance with the different resistances of the selectable resistive elements.

It is preferable that each of the selectable resistive elements has a selecting signal terminal for receiving a selecting signal so that any one of the selectable resistive elements is selected in accordance with the selecting signal.

It is further preferable that each of the selectable resistive elements comprises a series connection of a resistor and a switching element between the emitter and the ground terminal and the resistors of the selectable resistive elements have different resistances from each other.

It is further more preferable that the switching element comprises a MOS field effect transistor.

It is alternatively preferable that the selectable resistive elements comprise MOS field effect transistors having different ON-resistances from each other.

It is also preferable that the first and second resistive elements comprise resistors.

It is also preferable that the first and second resistive elements comprise MOS field effect transistors being kept in operation in saturation state and having predetermined ON-resistances.

It is preferable to further provide MOS field effect transistors being between the emitters of the first and third bipolar transistors and the ground terminal, and the MOS field effect transistors are kept in operation in saturation state and having predetermined ON-resistances.

PREFERRED EMBODIMENTS

First Embodiment

Figure 2:
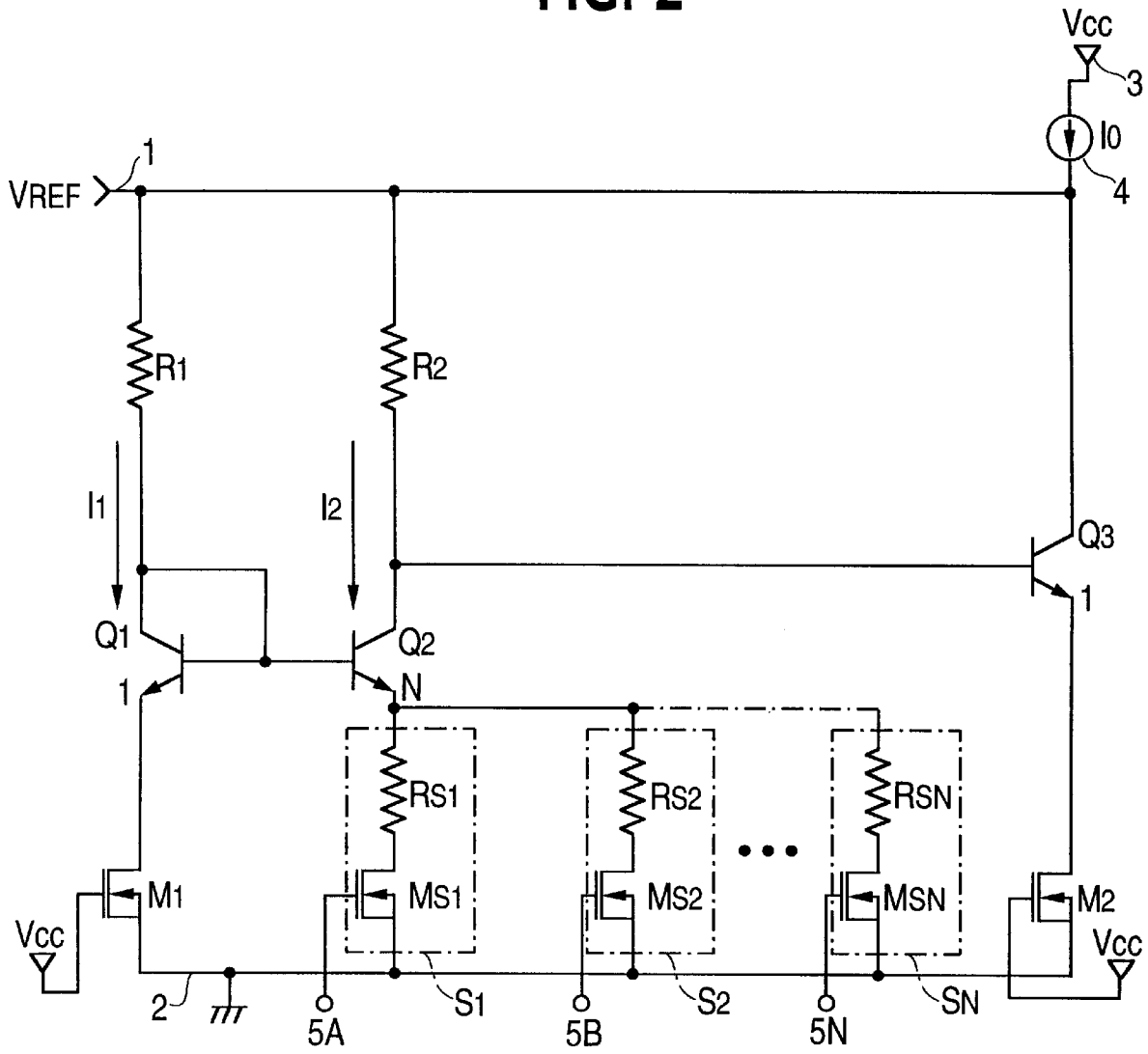
FIG. 2 is a circuit diagram illustrative of a reference voltage circuit in a first embodiment according to the present invention.

A first embodiment according to the present invention will be described with reference to FIG. 2. A reference voltage circuit includes three bipolar transistors Q1, Q2 and Q3, two MOS field effect transistors M1 and M2, reference voltage selecting circuits S1, S2–Sn, two resistors R1 and R2 and a current source 4. The transistor Q1 has a base and a collector which are interconnected to each other and also connected through a resistor R1 to a reference voltage output terminal 1 on which a reference voltage output Vref appears. A current I1 flows through the resistor R1 from the reference voltage output terminal 1 to the base and collector of the transistor Q1. The transistor Q1 has an emitter connected through a MOS field effect transistor M1 to a ground terminal 2 kept to have a ground potential. The transistor Q2 has a collector which is connected through a resistor R2 to the reference voltage output terminal 1. A current I2 flows through the resistor R2 from the reference voltage output terminal 1 to the collector of the transistor Q2. The transistor Q2 has an emitter connected through reference voltage selecting circuits S1, S2, –Sn to the ground terminal 2. The reference voltage selecting circuits S1, S2,–Sn are connected between the emitter of the transistor Q2 and the ground terminal in parallel to each other. The transistor Q2 has a base connected to the base of the transistor Q1. The transistor Q3 has a collector which is connected to the reference voltage output terminal 1 and a base connected to the collector of the transistor Q2 as well as an emitter connected through a MOS field effect transistor M2 to the ground terminal 2. A power voltage terminal 3 is connected through the current source 4 to the collector of the transistor Q3 and connected to the reference voltage output terminal 1 as well as to the resistors R1 and R2. An emitter size ratio of the transistor Q1 to the transistor Q2 is 1: N. An emitter size ratio of the transistor Q1 to the transistor Q3 is 1:1.

The MOS field effect transistor M1 has a drain connected to the emitter of the transistor Q1, a source connected to the ground terminal 2 and a base connected to a power voltage terminal 3 which has a power voltage Vcc. Since the power voltage is applied to the gate of the MOS field effect transistor M1, this MOS field effect transistor M1 is always operated in saturation region. The MOS field effect transistor M2 has a drain connected to the emitter of the transistor Q3, a source connected to the ground terminal 2 and a base connected to a power voltage terminal 3 which has a power voltage Vcc. Since the power voltage is applied to the gate of the MOS field effect transistor M2, this MOS field effect resistor M2 is always operated in saturation region.

The reference voltage selecting circuit S1 comprises a series connection of a resistor $R_{S1}$ and a MOS field effect transistor $M_{S1}$. The MOS field effect transistor $M_{S1}$ has a drain connected through the resistor $R_{S1}$ to the emitter of the transistor Q2, a source connected to the ground terminal and a gate connected to a selective terminal 5A. If the selective terminal 5A has the same voltage level as the power voltage Vcc, then the MOS field effect transistor $M_{S1}$ turns ON. If the selective terminal 5A has the ground voltage, then the MOS field effect transistor $M_s1$ turns OFF.

The reference voltage selecting circuit S2 comprises a series connection of a resistor $R_{S2}$ and a MOS field effect transistor $M_{S2}$. The MOS field effect transistor $M_{S2}$ has a drain connected through the resistor $R_s2$ to the emitter of the transistor Q2, a source connected to the ground terminal and a gate connected to a selective terminal 5B. If the selective terminal 5B has the same voltage level as the power voltage Vcc, then the MOS field effect transistor $M_{S2}$ turns ON. If the selective terminal 5B has the ground voltage, then the MOS field effect transistor $M_{S2}$ turns OFF.

The other reference voltage selecting circuits S3–Sn have the same structure as the reference voltage selecting circuits S1 and S2.

The MOS field effect transistors $M_{S1}$–$M_{SN}$ and the MOS field effect transistors M1 and M2 have the same gate size or the same ratio of channel length to channel width.

It is important that the emitter of the bipolar transistor Q1 is connected through the MOS field effect transistor M1 to the ground terminal 2, and that the emitter of the bipolar transistor Q2 is connected through the parallel connections of the reference voltage selecting circuits S1–Sn to the ground terminal 2, as well as that the emitter of the bipolar transistor Q3 is connected through the MOS field effect transistor M2 to the ground terminal 2. The reference voltage selecting circuits S1–Sn are provided in order to enable the reference voltage circuit to vary the output reference voltage level. The MOS field effect transistors M1 and M2 to compensate the circuit.

The reference output voltage Vref of the above reference voltage circuit will hereinafter be found. First, the reference output voltage Vref is found when the reference voltage selecting circuit is in ON state or is activated. "Vref1" means a reference output voltage appearing on the reference voltage output terminal 1 when the reference voltage selecting circuit is in ON state or is activated. "$V_{DS}$" means a drain source voltage of the MOS field effect transistor "$V_{DSM2}$" means a drain-source voltage of the MOS field effect transistor M2.

The output voltage Vref appearing on the reference voltage output terminal 1 may be expressed by the following equation $V_{BE}$ means a base-emitter voltage. $V_{BEQ1}$ means the base-emitter voltage of the transistor Q1.

$$\mathrm{Vref}1 = I2 \times R2 + V_{BEQ3} + V_{DSM2} \tag{10}$$

The current I2 will be found.

$$V_{BEQ1} + V_{DSM1} = V_{BEQ2} + R_{S1} \times I2 + V_{DSMS1}$$

Since the MOS field effect transistors $M_s1$, M1 and M2 have the same gate size, the approximation $V_{DSM1} = V_{DSM2} = V_{DSMS1}$ can be made and the above equation may be rewritten to $$I2 \times R_{S1} = V_{BEQ1} - V_{BEQ2} \tag{12}$$

$$V_{BEQ1} = (kT/q)\ln(I1/Is) \tag{13}$$

$$V_{BEQ2}(kT/q)\ln\,(I2/N \cdot Is) \tag{14}$$

$$I1 = (\mathrm{Vref} - V_{BEQ1} - V_{DSM1})/R1 \tag{15}$$

$$I2 = (\mathrm{Vref} - V_{BEQ3} - V_{DSM2})/R2 \tag{16}$$

where "k" is the Boltzmann's constant, "T" is the absolute temperature, "q" is the charge of electron and "Is" is the saturation current. The equations (13), (14), (15), and (16) are substituted for the equation (12) to obtain the following equation.

$$I2 \cdot R_{S1} = (kT)/q[\ln\{(\mathrm{Vref} - V_{BEQ1} - V_{DSM1})/(Is \cdot R1) - \ln\{(\mathrm{Vref} - V_{BEQ3} - V_{DSM2})/(N \cdot Is \cdot R1)\}]$$

Since the transistors Q1 and Q3 have the same emitter size, it is possible to approximate as follows.

$$V_{BEQ1} = V_{BEQ3} \tag{17}$$

The following equation (18) is introduced from the equations (11) and (17).

$$I2 = (1/R_{S1}) \cdot (kT/q)\ln(N \cdot R2/R1) \tag{18}$$

The equation (18) is substituted for the equation (10) to find the reference output voltage Vref.

$$\text{Vref1}=V_{BEQ3}+V_{DSM2}+(R2/RS1)\cdot(kT/q)\ln(N\cdot R2/R1) \quad (19)$$

As comparing the equation (19) to the equation (9), the equation (19) is added with the drain-source voltage $V_{DSM2}$ of the MOS field effect transistor M2 and the resistance R3 is substituted by the resistance RS1 in the reference voltage selecting circuit S1. The references R1 and R2 and the base-emitter voltage $V_{BEQ3}$ are the same.

A temperature coefficient of the base-emitter voltage $V_{BEQ3}$ of the bipolar transistor Q3 is −2 mV/° C. whilst a temperature coeffecient of the drain-source voltage $V_{DSM2}$ of the MOS field effect transistor is the specific coefficient possessed by the MOS field effect transistor. For those reasons, it is required that the sum of the above temperature coefficients has the same absolute value as but opposite polarity to the temperature coefficient in the third term of the right side of the equation (19) so that the total temperature coefficient of the reference voltage circuit is set zero, whereby zero gradient of the total temperature coefficient of the output voltage is obtained. This means that variation of the reference voltage due to temperature variation is eliminated.

The reference output voltage Vref2 of the second reference voltage selecting circuit S2 can be found in the same manner as described above. If the second reference voltage selecting circuit S2 is selected then the reference output voltage Vref2 of the second reference voltage selecting circuit S2 may be expressed as follows $$\text{Vref2}=V_{BEQ3}+V_{DSM2}+(R2/R_{S2})\cdot(kT/q)\ln(N\cdot R2/R1) \quad (20)$$

Also the reference output voltage Vrefn of the second reference voltage selecting circuit Sn can be found in the same manner as described above. If the second reference voltage selecting circuit Sn is selected, then the reference output voltage Vrefn of the second reference voltage selecting circuit S2 may be expressed as follows.

$$\text{Vrefn}=V_{BEQ3}+V_{DSM2}+(R2/R_{SN})\cdot(kT/q)\ln(N\cdot R2/R1) \quad (21)$$

Figure 3:
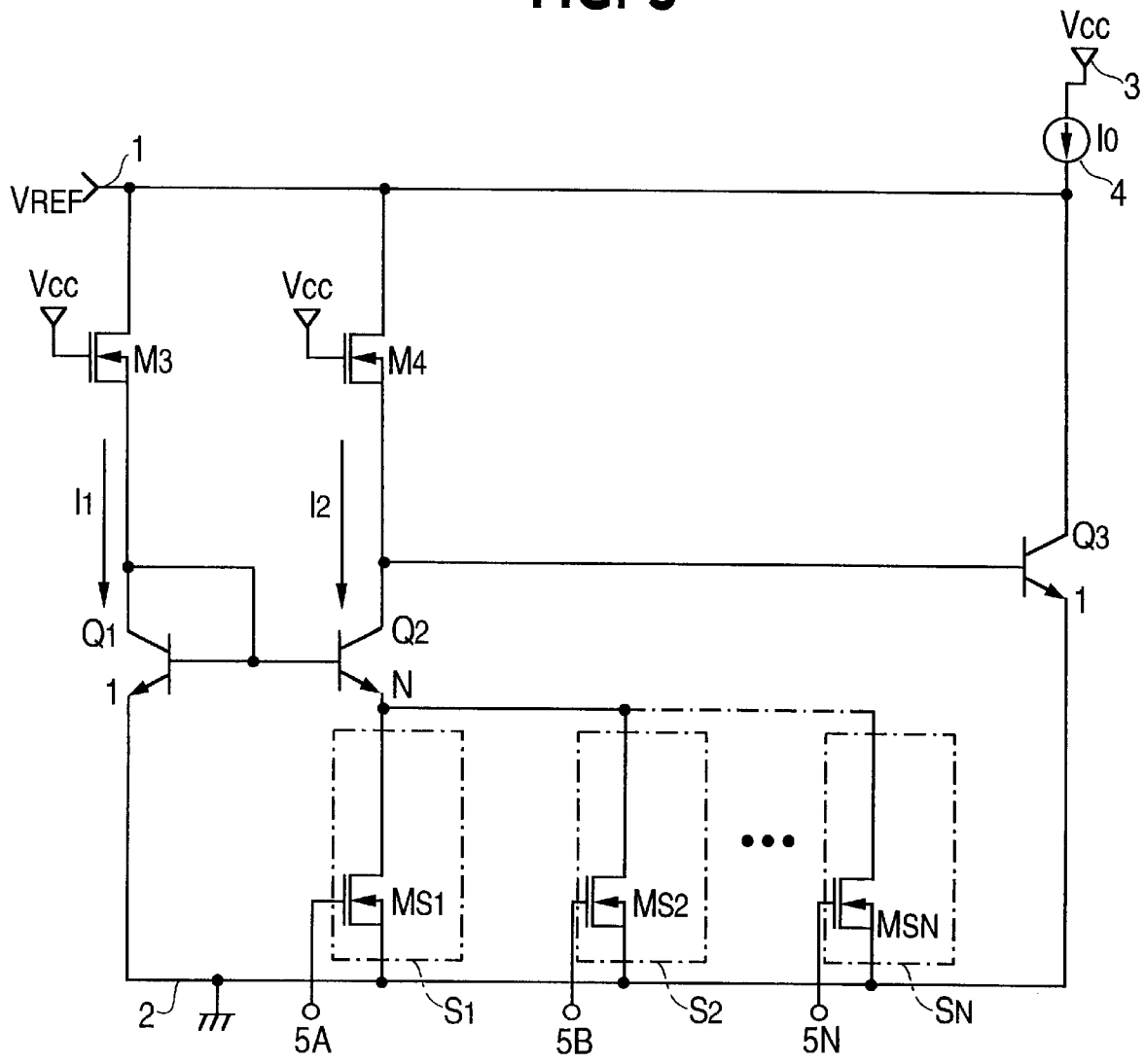
FIG. 3 is a circuit diagram illustrative of a reference voltage circuit in a second embodiment according to the present invention.

As can be understood from the equation (21), it is possible to set the reference output voltage Vrefn at any level by varying the resistances $R_{S1}$–$R_{SN}$. The provisions of the reference voltage selecting circuits enable the refernce output voltage to be varied Second Embodiment A second embodiment according to the present invention will be described with reference to FIG. 3. As can be seen from comparison of FIG. 3 to FIG. 2, the reference voltage circuit of this second embodiment is different from the reference voltage circuit of the above first embodiment in the following points. The resistor R1 in the first embodiment is substituted by an n-MOS field effect transistor M3 in this second embodiment whilst the resistor R2 in the first embodiment is substituted by an n-MOS field effect transistor M4 in this second embodiment. No resistor is provided in the reference voltage selecting circuit. The n-MOS field effect transistors M1 and M2 in the first embodiment are eliminated. The n-MOS field effect transistors M3 and M4 have gates which are supplied with the power voltage Vcc, for which reason the n-MOS field effect transistors M3 and M4 are always operated in the saturation region.

The reference voltage selecting circuit in this second embodiment shows the same operations as in the first embodiment except for the following situations. In the above first embodiment, the resistors $R_{S1}$–$R_{SN}$ are switched by the n-MOS field effect transistors $M_{S1}$–$M_{SN}$ to set the reference voltage at any level. By contrast, in this second embodiment, ON-resistance or the reciprocal number of the conductance=1/gm is utilized in place of the resistor so as to set the reference voltage at any level.

No provision of the resistor in the reference voltage selecting circuit results in reduction in area of the chip. The effect of the reduction in area of the chip is remarkable as a large number of the output voltage levels is set.

The reference output voltage level of the novel reference voltage circuit in this second embodiment will hereinafter be found. The conductance "gm" of the MOS field effect transistor may be expressed by the following equation.

$$Gm=\mu\text{Cox}\cdot(W/L)(V_{GS}-V_{th})$$

where $\mu$ is the mobility of carriers, Cox is the gate capacitance, W is the channel width, L is the channel length $V_{GS}$ is the gate-source voltage, and Vth is the threshold voltage.

The reference output voltage Vref1 when the reference voltage selecting circuit S1 is selected is given by the following equation.

$$\text{Vref1}=V_{BEQ3}+(R_{SM4}/R_{SMS1})\cdot(kT/q)\ln(N\cdot R_{SM4}/R_{SM3}) \quad (22)$$

where Rs=1 gm $R_{SM3}$ is the ON-resistance of the n-MOS field effect transistor M3, RSM4 is the ON-resistance of the n-MOS field effect transistor M4, and $R_{SMS1}$ is the ON-resistance of the n-MOS field effect transistor $M_{S1}$ in the reference voltage selecting circuit S1.

As comparing the equation (22) to the equation (9), the resistances R1 and R2 in the equation (9) are substituted by $R_{SM3}$ and $R_{SM4}$ as the reciprocal numbers of the conductances of the n-MOS field effect transistors M3 and M4 in the equation (22). The resistance R3 in the equation (9) is substituted by $R_{SMS1}$ as the reciprocal number of the conductance of the n-MOS field effect transistors $M_{S1}$.

A temperature coefficient of the base-emitter voltage $V_{BEQ3}$ of the bipolar transistor Q3 is about −2 m V/° C. It is required that the temperature coefficient in the second term in the right side of the equation (22) is set 2 mV/° C. so that the total temperature coefficient of the reference voltage circuit is set zero, whereby zero gradient of the total temperature coefficient of the output voltage is obtained. This means that variation of the reference voltage due to temperature variation is eliminated.

The reference output voltage Vref2 of the second reference voltage selecting circuit S2 can be found in the same manner as described above. If the second reference voltage selecting circuit S2 is selected, then the reference output voltage Vref2 of the second reference voltage selecting circuit S2 may be expressed as follows.

$$\text{Vref2}=V_{BEQ3}+(R_{SM4}/R_{SMS2})\cdot(kT/q)\ln(N\cdot R_{SM4}/R_{SM3}) \quad (23)$$

Also the reference output voltage Vrefn of the second reference voltage selecting circuit Sn can be found in the same manner as described above. If the second reference voltage selecting circuit Sn is selected then the reference output voltage Vrefn of the second reference voltage selecting circuit S2 may be expressed as follows.

$$\text{Vrefn}=V_{BEQ3}+(R_{SM4}\cdot R_{SMSN})\cdot(kT/q)\ln(N\cdot R_{SM4}/R_{SM3}) \quad (24)$$

As can be understood from the equation (24), it is possible to set the reference output voltage Vrefn at any level by varying the resistances $R_{SMS1}$–$R_{SMSN}$. The provisions of the reference voltage selecting circuits enable the reference output voltage to be varied.

Whereas modifications of the present invention will no doubt be apparent to a person having ordinary skill in the art, to which the invention pertains, it is understood that embodiments as shown and described by way of illustrations are by no way intended to be considered in a limiting sense. Accordingly, it is to be intended to cover by claims all modifications which fall within the spirit and scope of the present invention.

What is claimed is:

1. A programmable reference voltage circuit comprising:

a reference voltage output terminal from which a reference voltage is outputted;

a ground terminal kept to have a ground potential;

a power terminal from which a power is supplied to said programmable reference voltage circuit, and said power terminal being connected through a current source to said reference voltage output terminal;

a first bipolar transistor having a collector connected through a first resistive element having a first resistance to said reference voltage output terminal, a base connected to said collector, and an emitter connected to said ground terminal;

a second bipolar transistor having a collector connected through a second resistive element having a second resistance to said reference voltage output terminal, a base connected to said base of said first bipolar transistor, and an emitter connected through a resistive element selecting circuit to said ground terminal;

a third bipolar transistor having a collector connected to said reference voltage output terminal, a base connected to said collector of said second bipolar transistor and an emitter connected to said ground terminal; and MOS field effect transistors being provided between said emitters of said first and third bipolar transistors and said ground terminal, and said MOS field effect transistors being kept in operation in saturation state and having predetermined ON-resistances, wherein said resistive element selecting circuit includes a plurality of selectable resistive elements having different resistances from each other and said selectable resistive elements are connected between said emitter and said ground terminal in parallel to each other, and wherein said resistive elements selecting circuit is capable of selecting any one of said selectable resistive elements so that said emitter of said second bipolar transistor is connected through said selected one of said selectable resistive elements to said ground terminal, whereby said programmable reference voltage circuit is capable of varying said reference voltage in accordance with said different resistances of said selectable resistive elements.

* * * * *